United States Patent [19]

Bair, Jr.

[11] 4,048,762

[45] Sept. 20, 1977

[54] SEGMENTED GRINDING WHEEL

[75] Inventor: James G. Bair, Jr., Wexford, Pa.

[73] Assignee: Fox Grinders, Inc., Pittsburgh, Pa.

[21] Appl. No.: 712,968

[22] Filed: Aug. 9, 1976

[51] Int. Cl.[2] ..... B24D 5/06

[52] U.S. Cl. ..... 51/206.5; 407/49

[58] Field of Search ..... 29/105 R; 51/206.5; 125/15

[56] References Cited

U.S. PATENT DOCUMENTS

| | | | |
|---|---|---|---|
| 779,848 | 1/1905 | Hart | 51/206.5 |
| 1,843,287 | 2/1932 | Larsson | 51/206.5 |
| 2,799,979 | 7/1957 | Shotey | 51/206.5 |
| 3,418,762 | 12/1968 | Dooley | 51/206.5 |
| 3,777,443 | 12/1973 | Shaw | 51/206.5 |

*Primary Examiner*—Gary L. Smith

*Attorney, Agent, or Firm*—Buell, Blenko & Ziesenheim

[57] ABSTRACT

A cylindrical wheel has a channel formed at its periphery. A plurality of bolts pass through the sides of the channel and transverse it. A plurality of uniform grinding segements are inserted into the channel. Each segment has a radius on opposite edges. The radius is adjacent to a bolt. Adjacent segments are adjacent to one bolt.

1 Claim, 6 Drawing Figures

SEGMENTED GRINDING WHEEL

This invention relates to improvements in segmented grinding wheels.

Segmented grinding wheels are old. See, for example, U.S. Pat. No. 3,636,665. One problem presented by the existing segmented grinding wheels is the difficulty in the assembly of the wheel and replacing grinding segments. The present invention overcomes these difficulties.

I provide a grinding wheel comprising a cylindrical wheel adapted to be rotated about its axis, the wheel having a channel formed at the periphery by opposing sides of the wheel; a plurality of bolts passing through the sides of the wheel and traversing the channel, the bolts are spaced apart equally about the wheel; and a plurality of uniform grinding segments inserted into the channel, each segment having an outer edge which engages a work piece when grinding and a bottom area opposite the outer edge which is inserted within the channel, each segment has a pair of opposite side faces, each segment has a pair of opposed side edges each having a radius in the bottom area, each radius is adjacent to one bolt, a pair of adjacent segments are adjacent to the same bolt; and a wedge inserted between at least one face of one segment and one side of the wheel forming the channel.

Referring to the figures, a grinding wheel assembly 10 is shown having a cylindrical wheel 12 which is adapted to be rotated about its axis. The wheel 12 has a channel formed at the periphery by opposing sides 14 and 16 of the wheel 12.

Figure 2:
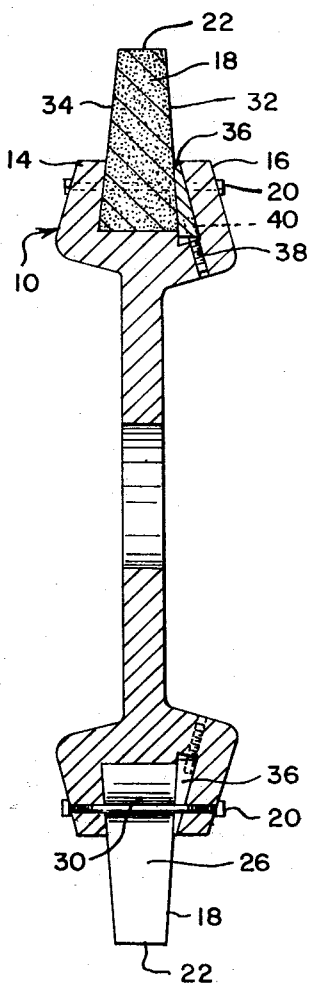
FIG. 2 is a fragmentary cross sectional view on the line II—II of FIG. 1 to illustrate how the stone segments are mounted relative to the wheel along the periphery in a channel circumferentially and locked in the channel by a wedge which is held in position by a jam screw.
Figure 1:
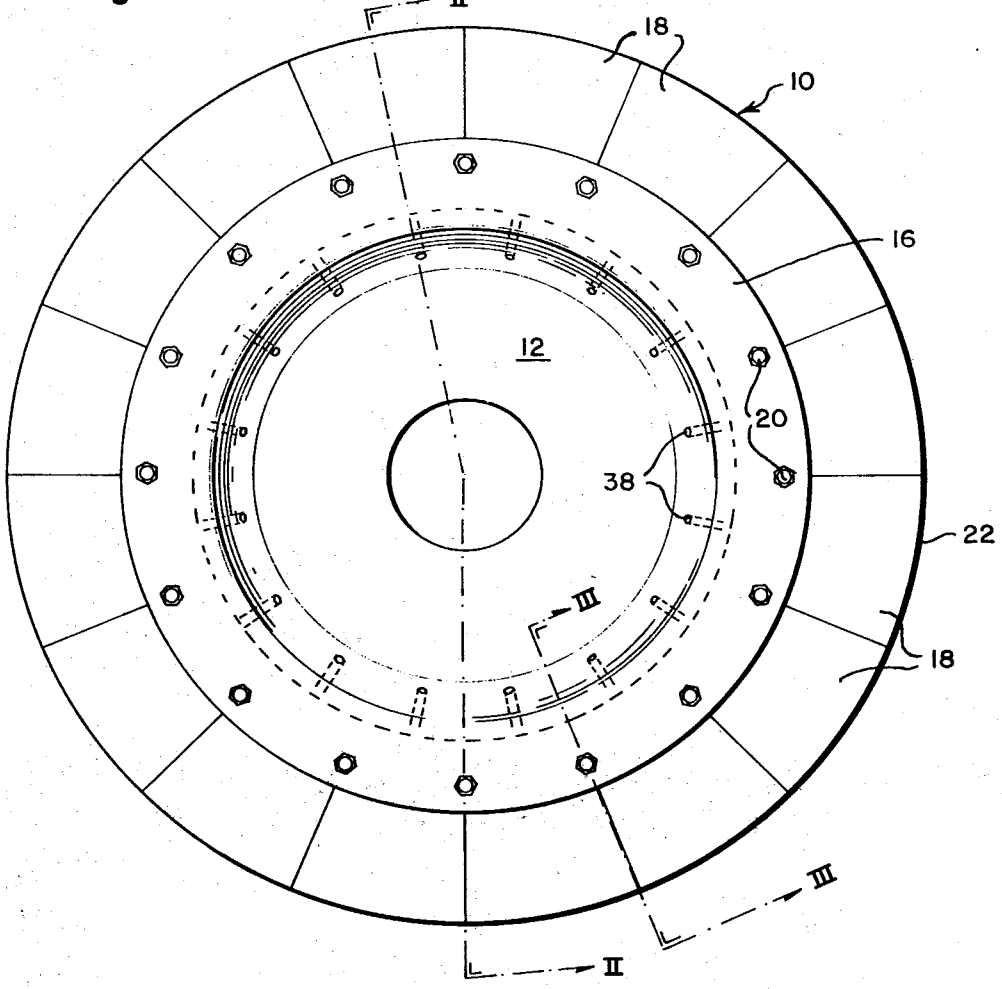
FIG. 1 is a side elevational view of the grinding wheel showing segments, bolts and wedge jam screw holes.
Figure 4:
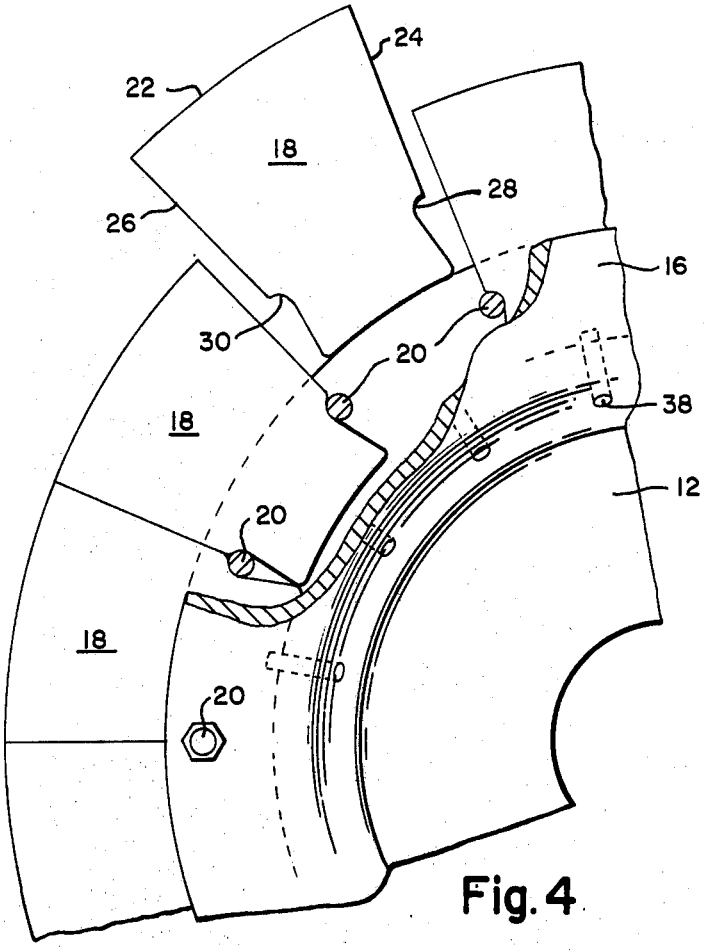
FIG. 4 is a fragmentary side elevation view (enlarged) of three or more grinding segments with a portion of the side of the channel wall of the wheel removed and illustrating how one segment can be removed and replaced between the bolts and adjacent segments.
Figure 3:
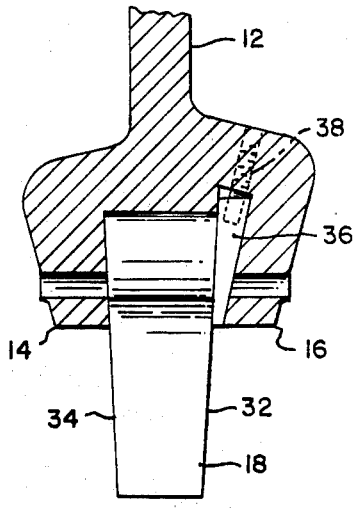
FIG. 3 is a fragmentary cross sectional view taken on the line III—III of FIG. 1, which shows the grinding segment and wedge mounted in the channel of the wheel having a bolt which serves as a restraining means against the channel walls (or flanges) separating and releasing the segments.
Figure 5:
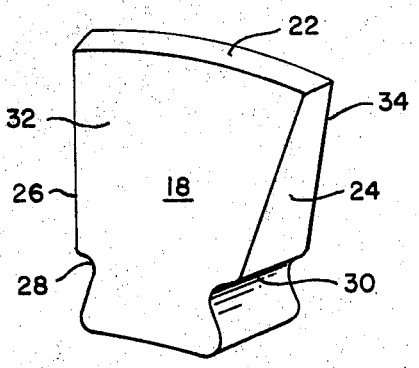
FIG. 5 is an isometric view of a grinding segment.
Figure 6:
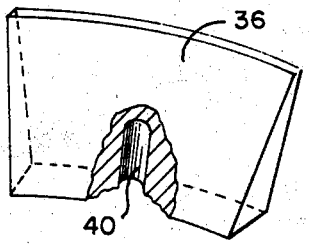
FIG. 6 is an isometric view of the wedge shown in FIGS. 2 and 3.

A plurality of bolts 20 pass through the sides 14 and 16 of the wheel 12 and traverse the channel. The bolts 20 are spaced apart equally about the wheel 12. A plurality of grinding segments 18 having an outer edge 22 which engages a work piece (not shown) when grinding and a bottom area opposite the outer edge 22 which rests in the channel, are positioned in the channel. Each segment 18 has a pair of opposed side edges 24 and 26 with each of them having a radius 28 and 30 in the bottom area. Each radius 28 and 30 is positioned adjacent to a bolt 20. A pair of adjacent segments 18 are adjacent to the same bolt 20 as shown in FIG. 4. Each segment 18 has a pair of opposite faces 32 and 34. To hold the grinding segments 18 in the channel, a wedge 36 is provided which is moved by a jam screw 38 inserted in the jam screw hole 40, thereby providing a gripping action between one side of the channel and the wedge 36 at the opposite side of the channel.

The bolts 20 are used as a restraining means against the channel walls to prevent them from separating under forces developed during the high speeds of rotation. Also the bolts in combination with the radii 28 and 30 of each edge 24 and 26 of the segments 18 prevents the segments 18 from sliding circumferentially within the channel. The combination of the bolts and radii facilitates ease of assembly and replacement of the segments.

I claim:

1. A grinding wheel comprising:

a. a cylindrical wheel adapted to be rotated about its axis, the wheel having a peripheral channel of truncated pyramidal cross section formed at the periphery by opposing sides of the wheel and a base;

b. a plurality of bolts passing through the sides of the wheel and traversing the channel intermediate its top and bottom whereby the sides of the channel are held against axial separation, the bolts are spaced apart equally about the wheel;

c. a plurality of uniform grinding segments of generally truncated pyramidal cross section inserted into the channel, each segment having an outer edge which engages a work piece when grinding and a bottom area opposite the outer edge which is inserted within the channel between the sides of the channel, each segment has a pair of opposite side faces, each segment has a pair of opposed side edges with each having a radius in the bottom area, each radius is adjacent to one bolt and a pair of adjacent segments are adjacent to the same bolt;

d. a radially movable wedge at each segment inserted between at least one face of one segment and one side of the channel; and e. means for radially moving said wedge from a locking position engaging the segment between the other side of the channel and the wedge and a release in which the segment is released.

* * * * *